United States Patent [19]

Heidmann

[11] Patent Number: 4,981,326

[45] **Date of Patent: * Jan. 1, 1991**

[54] ERGONOMIC CHAIR

[75] Inventor: Charles Heidmann, Strasbourg, France

[73] Assignee: Steelcase Strafor, Strasbourg, France

[ * ] Notice: The portion of the term of this patent subsequent to Apr. 3, 2007 has been disclaimed.

[21] Appl. No.: 246,458

[22] Filed: Sep. 19, 1988

[30] Foreign Application Priority Data

Sep. 22, 1987 [FR] France ..... 87 13248

[51] Int. Cl.[5] ..... A47C 1/024

[52] U.S. Cl. ..... 297/304; 297/300; 297/457; 297/337

[58] Field of Search ..... 297/300–302, 297/304, 312, 457, 303, 306, 317, 341, 342, 337

[56] References Cited

U.S. PATENT DOCUMENTS

| | | | |
|---|---|---|---|
| 3,434,756 | 3/1969 | Walkinshaw | 297/300 |
| 3,741,607 | 6/1973 | Cramer | 297/302 |
| 4,521,053 | 6/1985 | de Boer | 297/312 |
| 4,533,177 | 8/1985 | Latone | 297/301 |
| 4,744,603 | 5/1988 | Knoblock | 297/457 |

FOREIGN PATENT DOCUMENTS

| | | | |
|---|---|---|---|
| 4909 | 8/1987 | European Pat. Off. | 297/306 |
| 340976 | 10/1959 | Switzerland | 297/304 |

*Primary Examiner*—Peter R. Brown
*Attorney, Agent, or Firm*—Morgan & Finnegan

[57] ABSTRACT

An ergonomic chair having a movable, bendable chair back, which offers improved comfort and adjustability. The structure includes a series of rearward opening grooves in the chair back. This structure allows limited back flexibility. The chair also includes a mehcanism for adjusting the force needed to move the back, and another mechanism which limits the back's movement. Similar structure includes a seat which can slide forward and backward.

15 Claims, 9 Drawing Sheets

ERGONOMIC CHAIR

Figure 1:
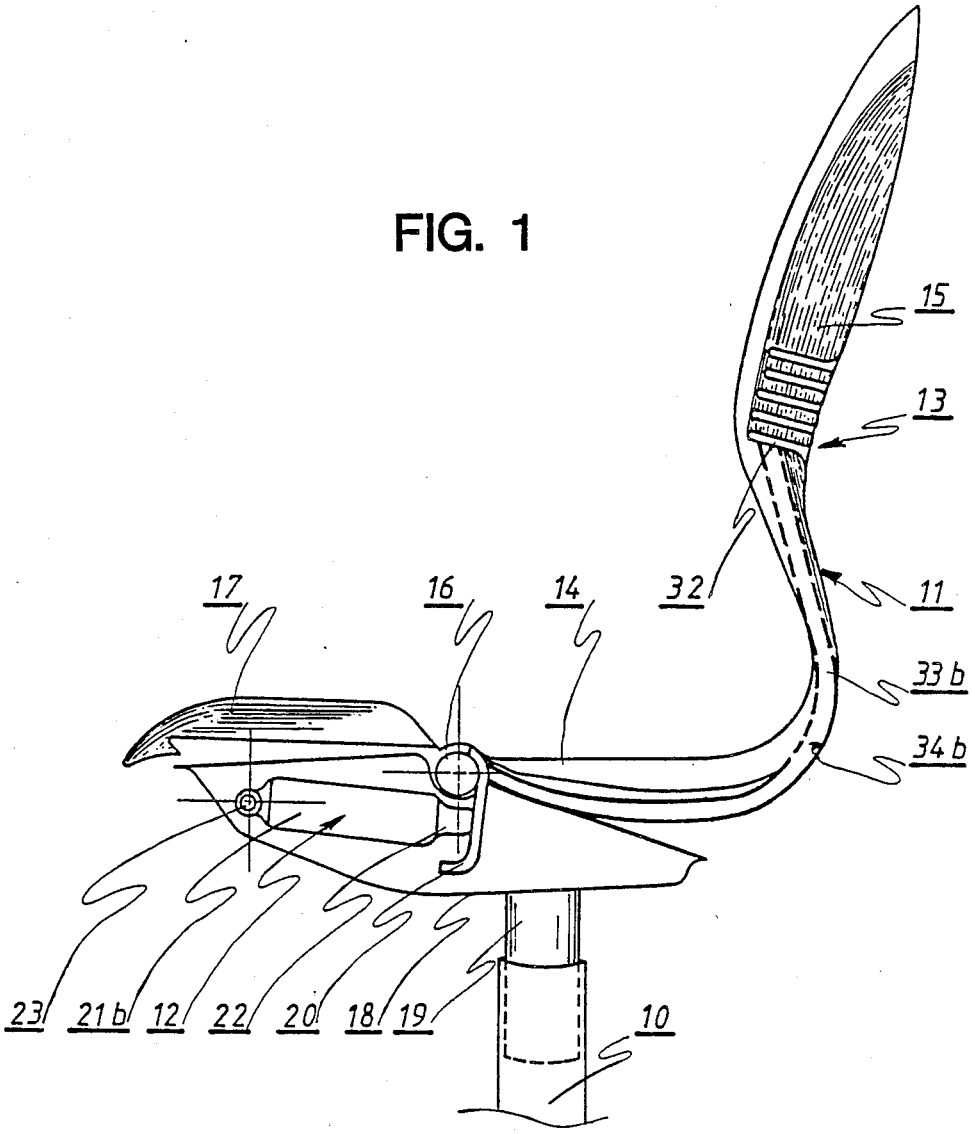
Figure 1:
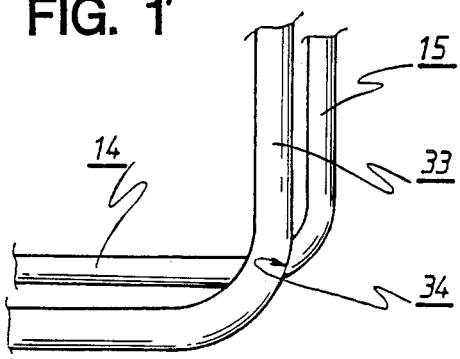

This invention relates to a new ergonomic chair, suitable for use as office chair and having exceptionnal characteristics of comfort and adaptability to the conformation and position of the sitting person.

The particularities of the chair concern especially the constitution of the seat-back unit and more particularly the combination of means allowing the best comfort and the ability to be continuously adapted to the person in any position. Of course, this unit is mounted on a support which can include well known height adjustment means; the support will not be described herein as is not included in the invention.

The most important characteristic of chairs in accordance with the present invention is the following: the seat-back unit of each chair is moulded in one piece flexibility of the seat back unit in relation with to fixed support results from a combination of mechanical means and the properties of the material from which the seat is made.

More particularly, a front part of the chair is mounted fixed on the support. The unit constituted by the rearward part of the seat and of the back is moulded in one piece. The back of the chair is pivotably connected to a housing pivoting and includes mechanical means allowing the elastic rocking of the back. The chair back further includes a structure allowing controlled deformation of the seat back, the chair back is adjustable in height so as to locate the deformation controlling structure in the most comfortable position for the user. Which whose is limited rearwardly.

The foresaid mechanical means consist in the combination of a plate fixed on the pivoting axis of the foresaid moulded piece and a spring. The spring exerts force on this plate when the seat is rocked backwards by the weight of the person, limiting the motion of the seat.

The tension exerted on the seat back can be controlled by modifying the point on the plate at which the spring applies force; for this purpose, an adjusting screw allows a vertical movement of the spring end which presses against the plate. Lastly, in order to allow the locking of the foresaid seat in any rocking position, there is an accessable lever which can adjust at will the position of the foresaid plate.

The seat-back unit is moulded in one piece, including elastic rocking means as described, and the invention concerns the combination, with the mechanical means, of a back structure allowing the upper part of this seat back to be elastically flexed rearwardly, preferably at the level of the shoulders, under the pressure of the body of the person. Such a structure is preferably the same as the structure described in inventor's patent application Ser. No. 07/243,903, for a "semi rigid structure having the controlled capacity to be unidirectionally deformed, particularly used for the making of ergonomic seats" filed together with this application.

Such a structure is obtained by moulding the foresaid piece moulded in one piece and providing in the back, horizontal ribs located at the back of the seat. The ribs are thick and rigid while the part located at the front is curved and thinner. The seat back, seen from the rear, appears to include narrow grooves which compress under the pressure of a person, allowing a slight and limited bending rearwards of the top of the seat back.

Thrusts are provided inside the grooves in order to limit the amplitude of this flexion, which reach an angle of 1° in the example of the other foresaid patent application.

This embodiment presents, moreover, another advantage, conferring another characteristic included in the invention. In comparable present seats, the metallic structure including the moulded elements forming the seat and the back is generally mounted in the axis of the seat. On the contrary, according to the invention, the seat-back unit is moulded in one piece, this structure being mounted to a frame. Two of these pipes are L-shaped of metallic pipes. The horizontal leg of the "L" corresponding to the seat being located under the corresponding part of the foresaid moulded piece, and the approximately vertical leg reinforcing the back as high as the bending zone this leg being located at the rear of the corresponding part of the moulded piece. The pipes cross the top surface of the moulded piece in the jointing zone between the seat and the back. Thus, the armrests can be easily fixed in this semi-circular shape.

Lastly, it should be observed that all of the controls (adjustment and locking) attached to the fixed front portion of the seat.

According to an other embodiment, in order to increase the comfort of this chair, the front portion of the seat is joined to a pad allowing the seat to slide forwards and backwards in relation to the housing which housing includes the mechanical means above described for the elastic rocking. The resulting sliding motion in relation to the pivoting axis is self operated, based upon the profile and the weight of the person.

Figure 2A:
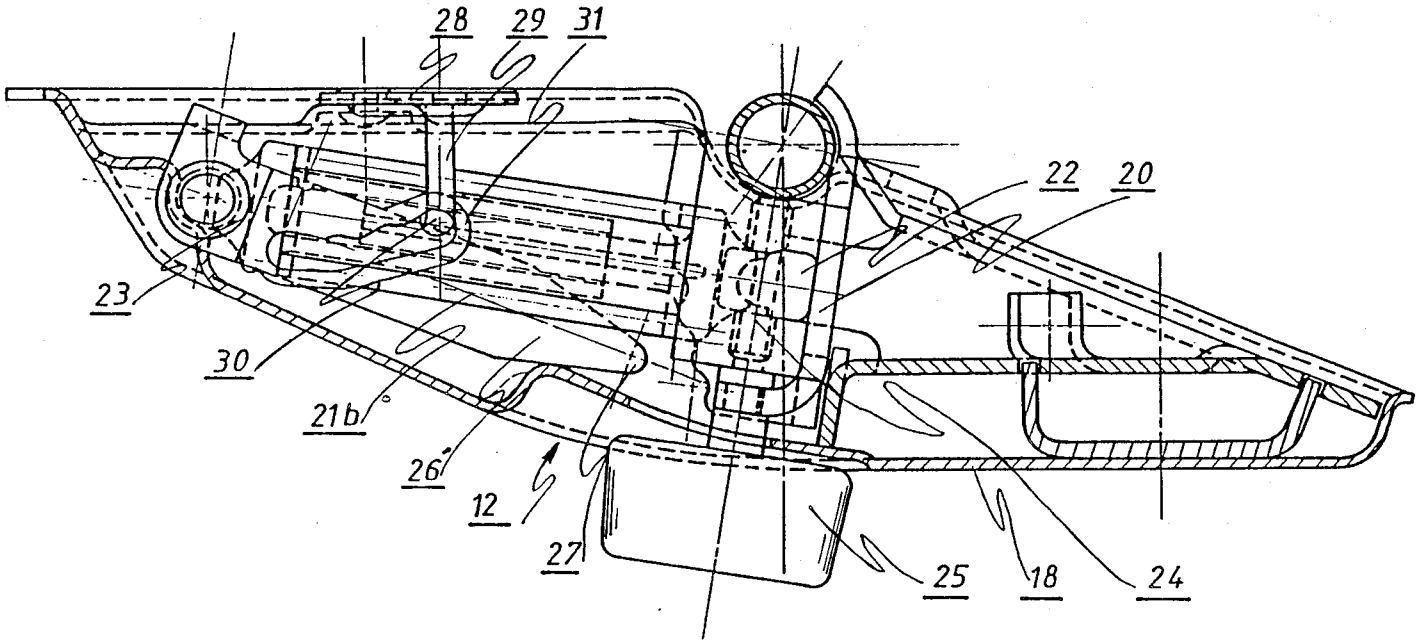
Figure 2B:
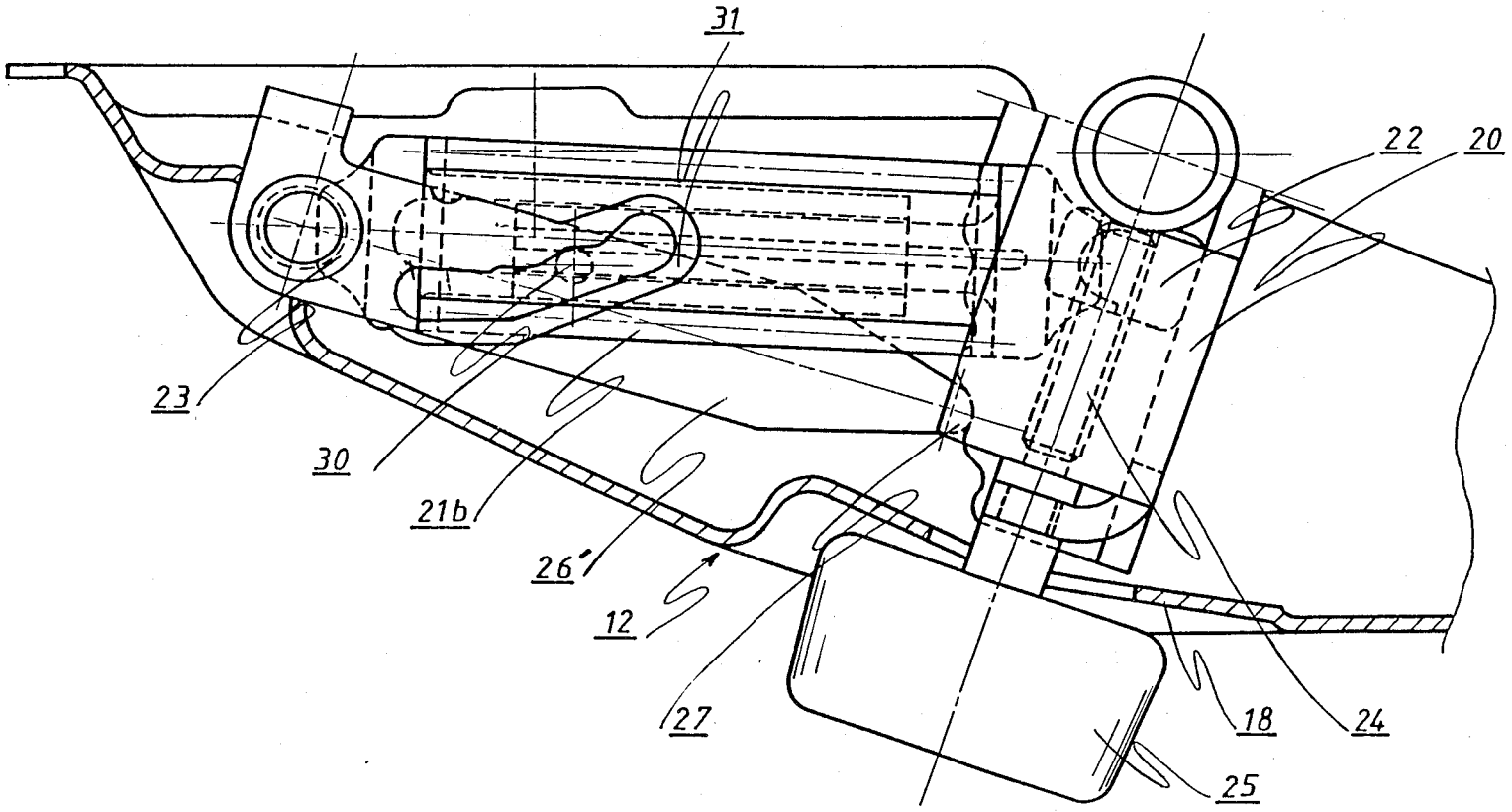

This invention will now be described in detail to a preferred embodiment, referring to the accompanying drawings, wherein:

FIG. 1 is a diagrammatic cross section of the chair,

FIG. 1' is a simplified and expanded detail of the FIG. 1,

FIGS. 2*a* and 2*b* are sections according to the same plan of the pivoting mechanisms of the seat-back unit.

Figure 3:
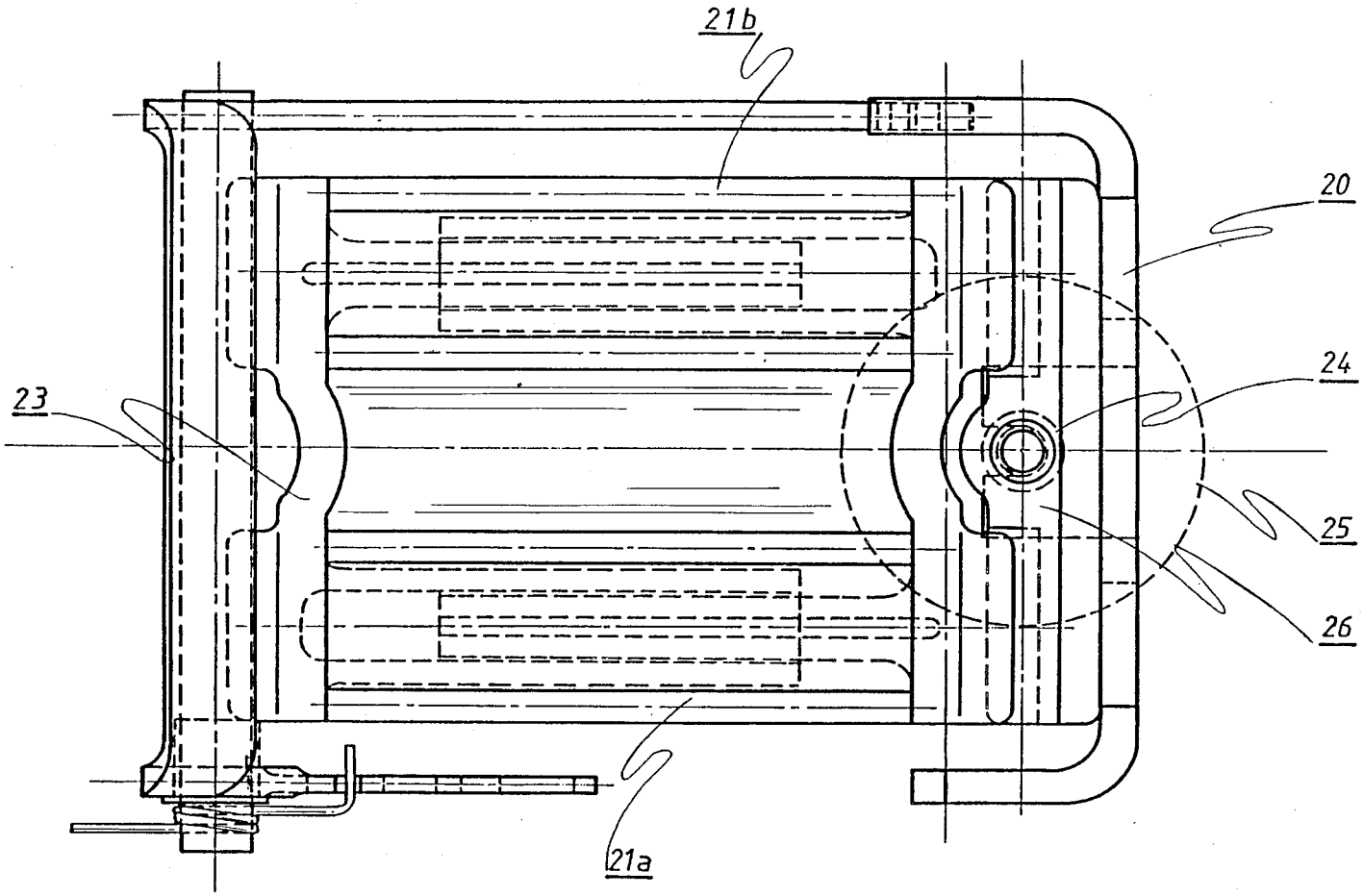
Figure 4:
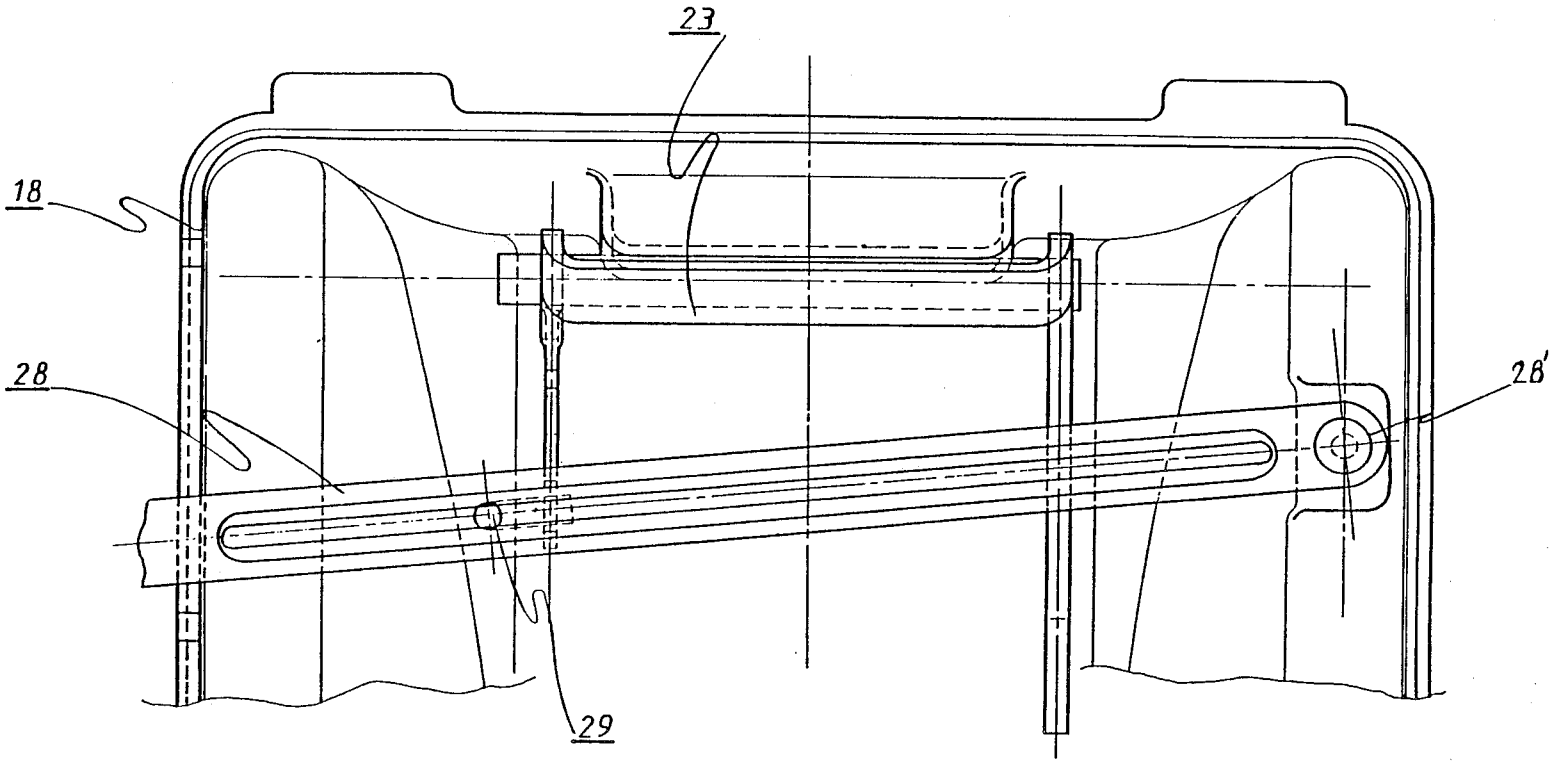
Figure 5:
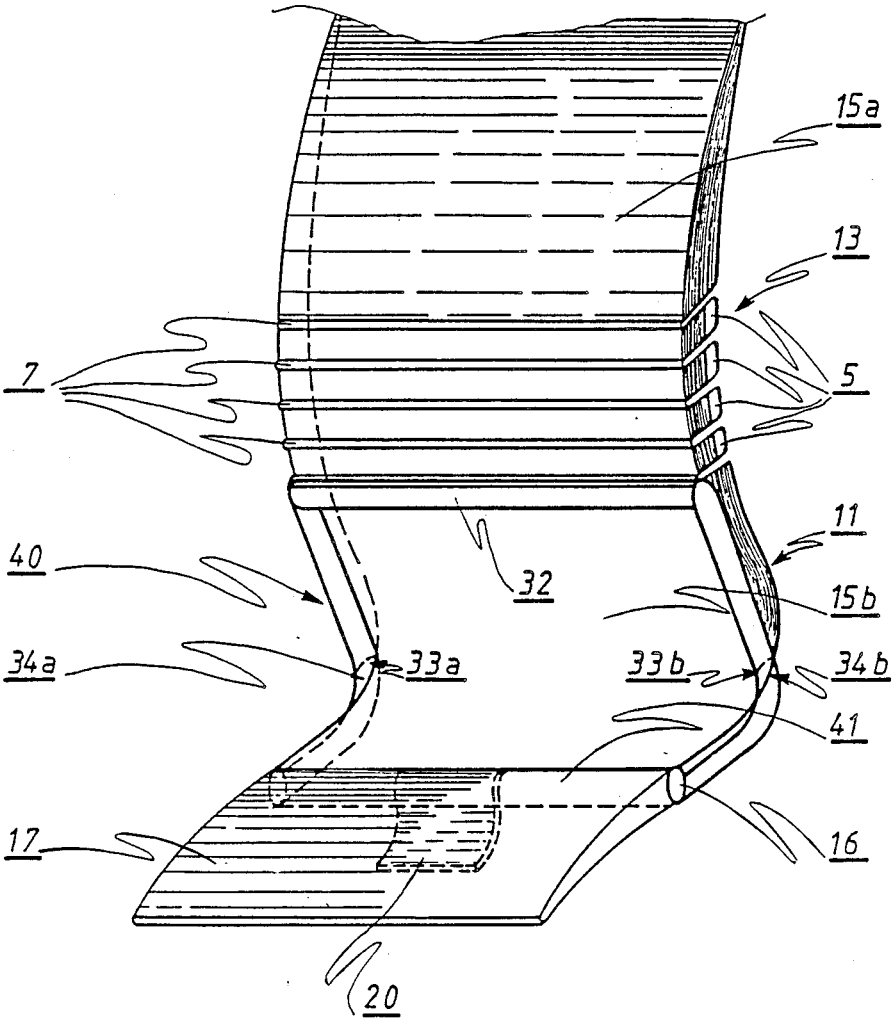
Figure 6:
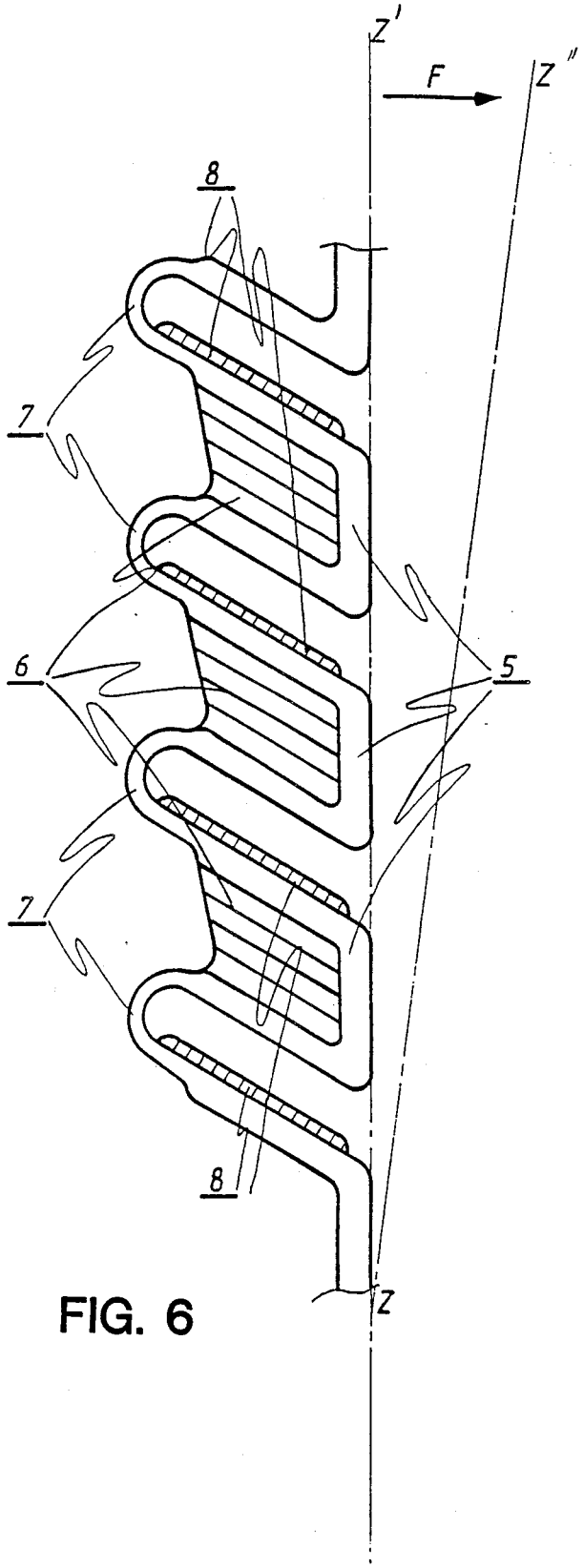
Figure 7:
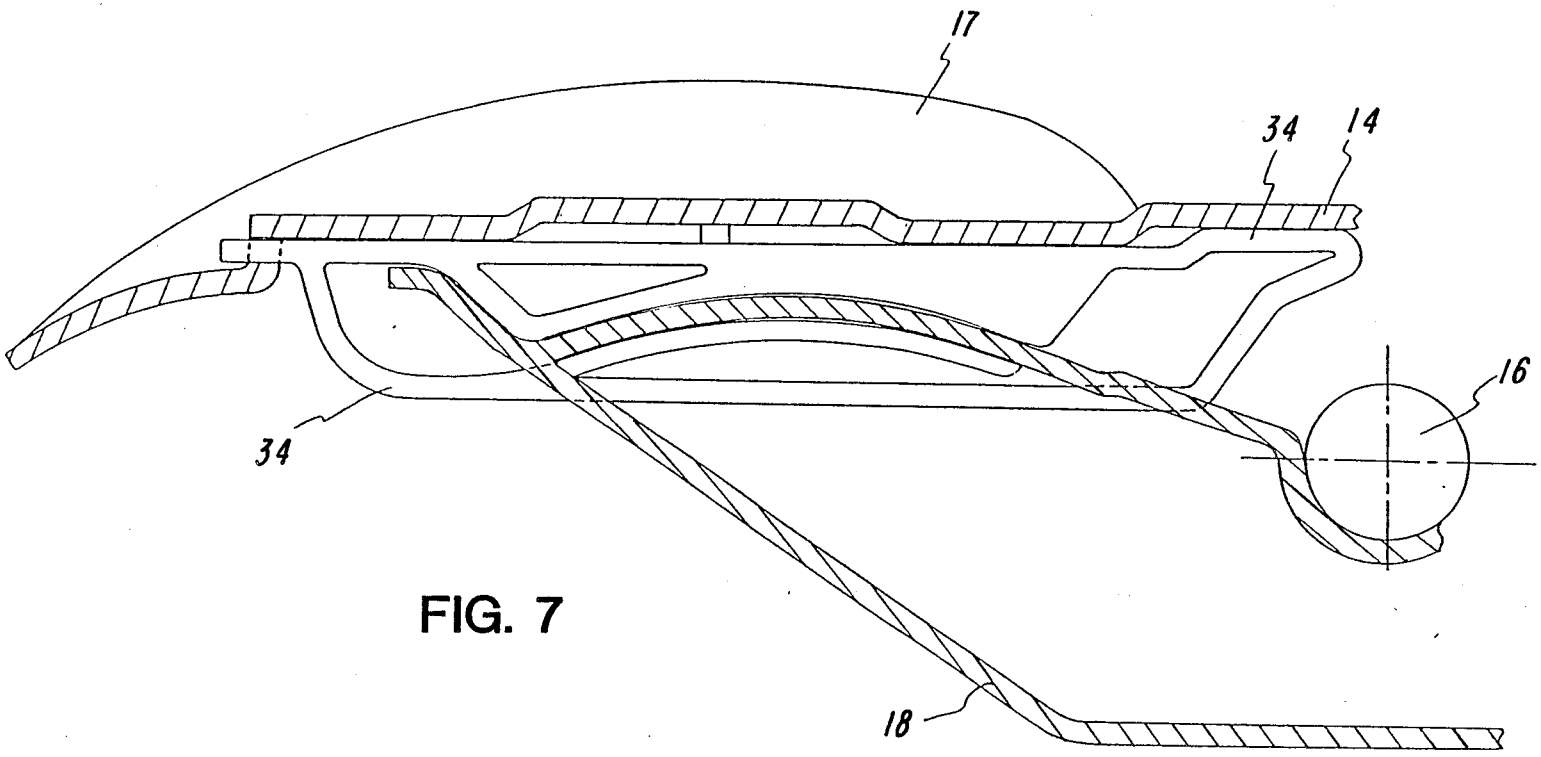
Figure 8:
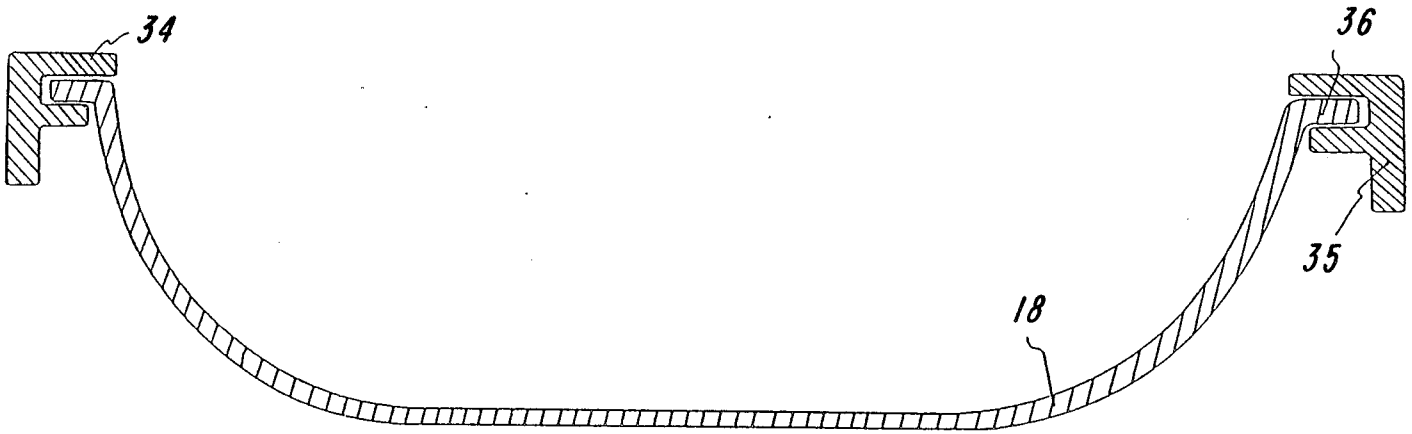

FIG. 3 and FIG. 4 are top-views of the retainer,

FIG. 5 is a perspective view showing the curved pipe structure attached to the seat, FIG. 6 is a diagrammatic section of the structure having predetermined flexibility in a primary direction allowing the controlled bending backwards, FIG. 7 is a partial section similar to the FIG. 1, illustrating another embodiment of the invention including sliding means for the seat, FIG. 8 is a diagrammatic section showing the portion of the sliding pad located on the casing border.

Referring firstly to the FIG. 1, it should be observed that the chair according to the invention, mounted on a fixed support 10, the height of which can be adjusted, presents the main characteristic following: it includes a seat-back unit moulded in one piece 11. The movements and deformations of this piece in relation to the support 10, due to the profile and the positions of the person, result from the combination of mechanical means 12 and the properties of a structure moulded with the piece 11 and noted 13.

More particularly, the one-piece cast seat back unit 11 includes an approximately horizontal portion 14, constituting the main part of the seat, and an approximately vertical portion 15, the whole of which comprises the seat back unit.

The portion 14 is pivotally mounted to horizontal axis 16, at the rear of a fixed portion of the seat 17, rigidly locked with the support 10 and covering a housing 18, which contains the retainer of the piece 11 and in which the jack 19 allowing the height adjustment of the seat is mounted.

This part 14 is rigidly locked with the part 15. The backward flexing property of the upper zone of the part 15 is due to the structure 13.

Referring now to the FIGS. 2, 3 and 4, the detail of the mechanism 12 is shown.

Mechanism 12 includes a bearing plate 20, compressing continuously the free extremities 22 of both springs 21*a* and 21*b*, the two other extremities of which being fixed at the front of the housing 18. This plate 20 rotates rigidly locked with the horizontal axis 16, so that the rocking of the piece 11 is elastically opposed by springs 21.

Means adjusting the drawback force of the springs 21 are provided, consisting of a screw 24, operated by a button 25, accessable from the outside of the housing 18. This screw cooperates with a threaded hole of a slider 262 jointing the extremities 22 of the springs 21, so that turning screw 24 varies the contact points of the springs on the plate 20, and consequently varies the force which must be applied to those springs in order to rock the piece 11.

Thus, as shown in FIG. 2*a*, this point is located at the bottom of the plate 20. In FIG. 2*b*, this point is at the top of the foresaid plate increasing the strain necessary the tenseness consequently to rock the seat back.

By another way, there is a locking system of the mechanism, including thrust rod 26, mounted at the front of housing 18 and pivoting on axis 23 at its front, the rear of the rod immobilizing the plate 20 against any forwards movement. For this purpose the person sitting in the seat moves of a lever 28 pivoting in 28 acting by a finger 30 sustained by an axis 29 upon the tilting height of the push button 25. A notched guide 31 defines a certain number of finger positions, i.e. possible limits for the tilting degree of the plate 20, and consequently for the piece 11.

The invention is made with the combination of this mechanism and the structure 13. Now we will refer to the FIG. 5 and FIG. 6 to explain the design and the role of this structure.

Referring to the FIG. 6, it should be noted that this structure, moulded with the entire piece 11, preferably made of polypropylene, includes rigid blocks 5, spaced together by ribs 6 and jointed by webs 7, of thinner and/or more flexible material, being the only parts of the structure which can be deformed.

The thickness of each webs is small, and when a strain is applied upon the structure in the direction F, the whole direction of the structure which is now ZZ', will be ZZ", the angle Z'ZZ" being small, in relation to the number of webs. Moreover, in order to limit at will this angle, ribs 8 are provided inside the webs, or inside a few of them. The overall deformation of the structure depends consequently on two foreseeable factors, i.e. the number of webs 7 and of ribs 8.

By another way, because of its very constitution, the structure can only be deformed in the direction F, and it cannot be deformed in the opposite direction. This structure is original, and is the object of the above cited patent application. The combination with the mechanism illustrated in FIGS. 2, 3 and 4 is also original and constitute the object of the present application.

Referring to the FIG. 5, the upper part 15*a* of the back 15 can be bended slightly because of the structure 13, the bending being limited in relation to the lower part 15*b*, allowing the optimal comfort to the person.

In the case of a chair including a curved seat, at least in the central part, the structure is located in this central part, the lateral parts being flat, as it is described and illustrated in the other application above cited.

By another way, referring also to the FIG. 5 of the present application, the form of the piece 11, allows it to be jointed to frame made of tubular or semi-circular metallic pipes 40, entirely located on the periphery of the foresaid piece 11. Thus, this frame comprise two horizontal pipes, the lower pipe 41, corresponding to horizontal axis 16, and the upper pipe 32, in which the lowest rib of the structure 13 is fixed. It also includes two L-shaped pipes 33*a* and 33*b*, the approximately legs being placed under the seat 14, and the approximately vertical legs which are placed in the front of the back 15, the L-shaped pipes crossing the piece 11 in 34*a* and 34*b* (FIG. 1'). This design is also original and is a part of the invention. It is also because of this configuration that all of the controls of this seat (button 25—leyer 28 and depending components) can be placed in the front of housing 18.

Of course, the different parts of the piece 11 are curved, as it is partially shown in FIG. 1, and they will be covered by an upholstering usual for this kind of chair.

Referring lastly to the FIG. 7 and FIG. 8, we find again the horizontal axis 16 around which the horizontal part 14 of the piece 11, is pivotally mounted this axis being supported by housing 18 the mechanism described according to the FIGS. 2, 3 and 4.

According to this alternative embodiment of the invention, the front seating zone 17 is not rigidly affixed to the front part of the housing 18, which is sustained, by the pivoting axis, rather includes means allowing the seat to slide backward to forward.

These means consist of an intermediate piece 34 to which is mounted the portion 17 and forming two lateral pads 35 (FIG. 8), which can slide on the lateral borders 36 of the housing 18.

The seat is, movable from backward to forward in relation to the housing 18 and consequently to the axis horizontal 16, so that when seat 14 rocks it goes backwards or forwards with regard to the support 10, in relation to the weight of the person, who find so a third element of comfort.

Moreover, it should be observed that the embodiment of FIG. 1 can be modified as shown in FIGS. 7 and 8: in FIG. 1 the horizontal front portion 17 and the horizontal rear portion 14 were joined at the level of the axis 16 horizontal whereas in this embodiment the joining is located a certain vertical distance from the horizontal axis 16, thus confering a certain flexibility to this joining and eliminating consequently the "bar effect", detrimental to the comfort of the chair, thus having a fourth element of comfort adapted to the comformation of the person.

The above description is only an example of embodiment, of course any other embodiment designed in regard to the above described chair is inside the scope of this invention, defined by the following claims. The main basis of this invention is the combination of mechanical means and the flexibility of the material giving the ergonomic optimal character to the chair. The semi-rigid structure with an unidirectionnal controlled flexibility, the preferred mean, can be replaced by any other equivalent structure, also the polypropylene is a preferred material for the moulding, but can be changed in any other equivalent material. Lastly, the chair including these characteristics can be provided with elbow rests supported by the tribular dished part or not. Consequently, it can be either a chair or an armchair, with the same characteristics.

I claim:

1. An ergonomic chair comprising:

a seat having a frontward and a rearward portion and a horizontal pivoting axis;

a fixed support of a height which can be adjusted;

a one-piece seat back unit having a structure at a definite height in relation to the seat's comfort, said structure allowing controlled rearward deformation of said seat back and having an overall flexibility due to both mechanical means and seat back material properties;

said frontward portion of said seat being mounted on said support, said rearward portion of said seat and said seat back being molded in one piece and pivotally attached to said frontward portion;

said mechanical means permitting said seat back to flexibly rock, said mechanical means including a plate pivotally affixed to said pivoting axis of said seat and a spring capable of exerting a force, said plate and spring being attached so that when said seat rocks backward, said plate pivots, and said spring is compressed by said plate, causing said chair to have a tenseness, thereby opposing said force exerted by said plate;

an adjusting screw for the adjustment of said tenseness of said chair;

a slider piece having a threaded hole, said slider piece being attached to said spring, said screw cooperating with said hole so that when said screw is rotated said slider moves, thereby varying where on said plate said spring applies said force.

2. An ergonomic chair according to claim 1, further comprising means for locking said seat back unit in any rocking position, said means further comprising:

a thrust rod, one end being pivotally mounted on the frontward portion of the seat, the other end of said thrust rod being engageable with said plate to inhibit the pivoting of said plate, and lever means cooperating with said thrust rod to adjust the position of the end of the thrust rod engageable with said plate for adjusting the degree of pivoting of said plate.

3. An ergonomic chair comprising:

a fixed base;

a housing rotatably attached to said fixed base so that said housing can rotate about a vertical axis, and a horizontal axis;

a front seat portion joined to said housing;

a deformable and pivotable seat back unit having a seat region and a back region, said back region having both an upper part and a lower part, a structure having a predetermined flexibility in a primary direction connecting said upper part and lower part, said structure including;

a solid plate of material having a plurality of slits in its rearward surface, said slits opening rearwardly, said slits extending only partways through said plate, said slits thereby defining a plurality of blocks in said rearward surface of said plate and a plurality of thin flexible regions of material at the frontward surface of said plate;

said blocks being joined to one another by said thin regions of said plate material;

said thin regions being dimensioned so that when a force is applied in a rearward direction said plate bends in a rearward direction as a result of said thin regions flexing; and a plurality of ribs corresponding in number to the number of slits, each said slit having at least one said rib lying within it, said lower part of said back region being fixedly attached to said seat region, said seat back unit being pivotally joined to said housing so that said seat back unit can pivot about said horizontal axis;

means for limiting the movement of said back in response to an applied force;

means for adjusting said means for limiting in response to said applied force so that a user can adjust how much force is needed to move said seat back.

4. An ergonomic chair as in claim 3 wherein said thin regions are curved.

5. An ergonomic chair as in claim 3 wherein the ratio of width to depth of each said slit limits the flexural angle of said slit to about 1°.

6. An ergonomic chair as in claim 3 wherein said structure having a predetermined flexible ability in a primary direction is located at a point on said seat back corresponding to the location of a user's shoulders.

7. An ergonomic chair as in claim 3 wherein said means for limiting further comprise;

a substantially vertical thrust plate rotatably attached to said horizontal axis, said thrust plate having a face disposed parallel to a thrust plate axis, said thrust plate being coupled to said seat region of said seat back unit so as to rotate about said horizontal axis when said seat back rotates about said horizontal axis; and, a compressible member separated from said horizontal axis by a distance, said member having a first end abutting said face of said thrust plate and a second end fixed to said housing at a point, said member being positioned so that when said seat region of said seat back unit moves downward, said plate rotates forward, compressing said member.

8. An ergonomic chair as in claim 7 wherein said means for adjusting further comprise:

a rotatably-mounted adjusting screw having a screw axis parallel to said thrust plate axis, said screw being positioned so that said screw axis is perpendicular to and intersects said horizontal axis; and, a slider having a threaded opening, said first end of said compressible member engaging said slider, said threaded opening of said slider engaging said screw so that when said screw is rotated said slider moves parallel to said screw axis, thereby altering said distance separating said horizontal axis and said compressible member, whereby the force needed to rotate said seat back unit about said horizontal axis can be adjusted.

9. An ergonomic chair as in claim 7 wherein said compressible member is a spring.

10. An ergonomic chair as in claim 7 further comprising locking means one end of which being pivotally attached to said housing the other end being engageable with said thrust plate to prevent said seat back from rotating backward beyond a selected position.

11. An ergonomic chair as in claim 10 wherein said means for locking further comprises:

a thrust rod having a rounded tip, said thrust rod being pivotally attached to said housing at said same point as said compressible member;

means for rotating said thrust rod about said point to a desired angular position relative to said point and maintaining said thrust rod in said desired position;

a stop plate having a wavy surface diagonally disposed with respect to said thrust plate axis, said stop plate being pivotally attached to said horizontal axis so that when said seat back moves rearward and downward under an occupant's weight, said stop plate pivots about said pivot axis until said wavy surface of said stop plate;

contacts said tip of said thrust rod, thereby stopping forward rotation of said plate and corresponding rearward displacement of said seat back.

12. An ergonomic chair as in claim 3 further comprising at least two curved pipes, each having a horizontal and a vertical leg, each said horizontal leg being located under said front of said seat back unit and each said vertical leg being located in front of and extending about as high as said flexing structure having a predetermined flexural ability.

13. An ergonomic chair as in claim 3 wherein said front of said front seat portion is joined to an intermediate member, said intermediate member being slidably connected to said housing by means for sliding located in said housing.

14. An ergonomic chair as in claim 3 further comprising arm rests attached to said curved pipes.

15. An ergonomic chair as in claim 3 wherein said seat back is made of polypropylene.

* * * * *